US008600288B2

(12) United States Patent
Shiraki et al.

(10) Patent No.: US 8,600,288 B2
(45) Date of Patent: Dec. 3, 2013

(54) IMAGE FORMING APPARATUS

(75) Inventors: Takamasa Shiraki, Yokohama (JP); Kazushige Kawamura, Sagamihara (JP); Yoshihide Ohta, Sagamihara (JP); Takayuki Andoh, Kawasaki (JP); Masato Ogawa, Sagamihara (JP); Takuji Takahashi, Yokohama (JP); Tetsuya Fujioka, Yokohama (JP); Yasunobu Youda, Sagamihara (JP); Kohji Hatayama, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 744 days.

(21) Appl. No.: 12/318,242

(22) Filed: Dec. 23, 2008

(65) Prior Publication Data

US 2009/0162082 A1 Jun. 25, 2009

(30) Foreign Application Priority Data

Dec. 25, 2007 (JP) ..... 2007-332791
Dec. 27, 2007 (JP) ..... 2007-337962
Oct. 14, 2008 (JP) ..... 2008-265648

(51) Int. Cl.
*B41J 29/38* (2006.01)
*B65H 29/22* (2006.01)
*B65H 39/06* (2006.01)

(52) U.S. Cl.
USPC ..... 399/410; 399/405; 399/85

(58) Field of Classification Search
USPC ..... 399/407, 408, 410, 397; 270/37, 58.23
See application file for complete search history.

(56) References Cited

U.S. PATENT DOCUMENTS 6,134,418 A * 10/2000 Kato et al. ..... 399/405
6,314,267 B1 * 11/2001 Kida ..... 399/405
6,353,727 B1 * 3/2002 Muraoka et al. ..... 399/410
6,421,509 B1 * 7/2002 Nomura et al. ..... 399/81
7,568,687 B2 * 8/2009 Sasamoto ..... 270/58.07

(Continued)

FOREIGN PATENT DOCUMENTS

JP 10-053372 2/1998
JP 11-327232 11/1999

(Continued)

OTHER PUBLICATIONS

Abstract of JP 10-250910 published Sep. 22, 1998.

(Continued)

*Primary Examiner* — Daniel J Colilla
*Assistant Examiner* — Ruben Parco, Jr.
(74) *Attorney, Agent, or Firm* — Harness, Dickey & Pierce, PLC

(57) ABSTRACT

An image forming apparatus includes an image forming unit, a first sheet stack portion, a sheet output section, and a post processing unit. The image forming unit forms an image on a sheet. The first sheet stack portion is provided at an upper face of the image forming unit. The sheet output section outputs the sheet on which the image is formed by the image forming unit from one side of the image forming apparatus to the first sheet stack portion. The post processing unit is provided adjacent to a lateral side of the image forming unit at an upstream side of the sheet output section to execute post processing on the sheet. A sheet subjected to post-processing by the post-processing unit is output to the first sheet stack portion from the same direction as a sheet not subjected to post-processing by the post-processing unit.

15 Claims, 13 Drawing Sheets

(56) References Cited

U.S. PATENT DOCUMENTS

| | | | | |
|---|---|---|---|---|
| 2001/0028819 | A1* | 10/2001 | Okamoto | 399/401 |
| 2001/0048831 | A1* | 12/2001 | Matsumoto et al. | 399/405 |
| 2002/0081134 | A1* | 6/2002 | Miyamoto et al. | 399/405 |
| 2002/0097428 | A1* | 7/2002 | Ferlitsch | 358/1.15 |
| 2004/0178572 | A1* | 9/2004 | Nishimura et al. | 271/298 |
| 2004/0228650 | A1* | 11/2004 | Saito | 399/107 |
| 2006/0145414 | A1* | 7/2006 | Yokobori et al. | 271/258.01 |
| 2007/0147855 | A1* | 6/2007 | Shimada | 399/21 |
| 2009/0154954 | A1* | 6/2009 | Waugerman et al. | 399/110 |

FOREIGN PATENT DOCUMENTS

| | | |
|---|---|---|
| JP | 3571986 | 9/2004 |
| JP | 3602930 | 12/2004 |
| JP | 3632726 | 3/2005 |
| JP | 3667211 | 7/2005 |
| JP | 2006-321167 | 11/2006 |
| JP | 4015582 | 11/2007 |
| JP | 4095373 | 6/2008 |

OTHER PUBLICATIONS

Abstract of JP 2001-072311 published Mar. 21, 2001.
Abstract of JP 2002-060118 published Feb. 26, 2002.
Abstract of JP 2003-156891 published May 30, 2003.
Abstract of JP 2004-334040 published Nov. 25, 2004.
Abstract of JP 11-175282 published Jul. 2, 1999.

* cited by examiner

| FIG. 8A |
| --- |
| FIG. 8B |

IMAGE FORMING APPARATUS

CROSS-REFERENCE TO RELATED APPLICATIONS

The present patent application claims priority pursuant to 35 U.S.C. §119 from Japanese Patent Application Nos. 2007-332791, filed on Dec. 25, 2007, 2007-337962, filed on Dec. 27, 2007, and 2008-265648, filed on Oct. 14, 2008 in the Japan Patent Office, the entire contents of each of which are hereby incorporated herein by reference.

BACKGROUND OF THE INVENTION

1. Field of the Invention

The present invention relates to an image forming apparatus, such as a copier, a printer, a facsimile machine, a plotter, a multifunctional device capable of performing several of the foregoing functions, or the like, and more specifically, to an image forming apparatus capable of outputting both a sheet subjected to post-processing and a sheet not subjected to post-processing to a so-called housing-internal space formed within the space occupied by the body of the image forming apparatus.

2. Description of the Background

Image forming apparatuses are used as copiers, printers, facsimile machines, and multi-functional devices combining several of the foregoing capabilities.

In a conventional image forming apparatus of a housing-internal output type, an upper face of an apparatus body is formed as a sheet stack portion to stack a sheet on which an image is formed, and a scanner serving as an image reading unit is provided above the sheet stack portion.

In the conventional image forming apparatus the sheet stack portion serving as an output tray portion is located within the space occupied by the body of the image forming apparatus, providing advantages such as a reduction in the size of the apparatus when the apparatus is set up. More specifically, the scanner is located relative to the sheet stack portion so that the space between the scanner and the sheet stack portion is as small as possible. Such a configuration reduces the height of the image forming apparatus, resulting in downsizing the apparatus as a whole.

In recent years, demand has arisen for such a housing-internal output-type image forming apparatus with a post-processing function, and some image forming apparatuses having such a function have been proposed.

For example, one conventional image forming apparatus includes a post-processing unit within a housing-internal space, to which a bundle of sheets bound by post processing is output.

Another conventional image forming apparatus includes a post-processing unit within a housing-internal space, in which a bundle of sheets bound by post-processing is output to a sheet output tray and a sheet not subjected to post-processing is output to a separated sheet output tray.

In still another conventional image forming apparatus, a post-processing tray is substantially vertically disposed alongside a scanner above a sheet output portion of an apparatus body, and a bundle of sheets bound by post-processing is output to a housing-internal space.

For those configurations in which the post-processing unit is located within the housing-internal space, the image reading unit is located all the higher for the post-processing unit, preventing the housing-internal space from being efficiently used as the sheet output space.

For one of the above-described conventional image forming apparatuses, the height of the image forming apparatus as a whole may be relatively high and, among sheets stacked on the sheet stack portion, the image side of a sheet subjected to post-processing may differ from that of a sheet not subjected to post-processing.

Further, when a plurality of sheets is stacked on the post-processing tray, a precedent sheet may need to pass through a sheet reverse unit before a subsequent sheet is fed, resulting in a reduction in productivity.

Also, there is increasing demand for a post-processing unit capable of performing a plurality of types of post-processing operations, such as staple binding, punching, seal stamp, and sorting, and a conventional image forming apparatus has a configuration in which such a post-processing unit is mounted at a lateral side of the apparatus body.

Another conventional image forming apparatus having a common output tray provided at a post-processing unit executes a control method when an interrupt request for image formation not including post-processing is received during execution of image formation including post-processing. In this control method, a plurality of sheets for the interrupted image formation including post-processing held at a staple unit during execution of the image formation not including post-processing.

However, according to the conventional control method, when image formation including post-processing is interrupted by image formation not including post-processing, some sheets for the interrupted image formation including post-processing are held at a sheet alignment portion of the post-processing unit until the interrupt processing is completed. Since there is a certain distance between the sheet alignment position and a housing-internal tray, the restart of interrupted processing is delayed by the distance, resulting in a reduction in productivity.

In another conventional control method that assumes there is a plurality of trays, interrupting image formation not including post is executed in parallel with processing and interrupted image formation including post-processing, and respective sheets are output to separate trays. However, if the conventional control method is used in an image forming apparatus with a single output tray, a sheet output by one image formation may prevent a sheet output by the other image formation, resulting in sheet jam.

SUMMARY OF THE INVENTION

In view of the above-described situation, the present disclosure provides an image forming apparatus capable of effectively using housing-internal space to output a sheet while reducing the height of the image forming apparatus and providing excellent productivity while preventing output failure from occurring at an output tray.

In one illustrative embodiment, an image forming apparatus includes an image forming unit, a first sheet stack portion, a sheet output section, and a post-processing unit. The image forming unit forms an image on a sheet. The first sheet stack portion is provided at an upper face of the image forming unit. The sheet output section outputs the sheet on which the image is formed by the image forming unit from one side of the image forming apparatus to the first sheet stack portion. The post-processing unit is provided adjacent to a lateral side of the image forming unit at an upstream side of the sheet output section to execute post-processing on the sheet on which the image is formed by the image forming unit. A sheet subjected to post processing by the post-processing unit is output to the first sheet stack portion from the same direction as a sheet not subjected to post-processing by the post-processing unit.

In another illustrative embodiment, an image forming apparatus includes an image forming unit, an image reading unit, a sheet stack portion, a sheet output portion, and a post-processing unit. The image forming unit forms an image on a sheet. An image reading unit is provided above the image forming unit. The sheet stack portion is provided between the image forming unit and the image reading unit. The sheet output portion outputs, to the sheet stack portion, the sheet on which the image is formed in the image forming unit. The post-processing unit is provided posterior to the sheet output unit to execute post-processing on the sheet on which the image is formed by the image forming unit. A sheet subjected to post-processing by the post-processing unit is output to the sheet stack portion from the same direction as a sheet not subjected to post-processing by the post-processing unit.

In still another illustrative embodiment, an image forming apparatus includes image forming means, sheet stack means, sheet output means, and post-processing means. The image forming means forms an image on a sheet. The sheet stack means stacks the sheet on which the image is formed by the image forming means and is provided at an upper face of the image forming means. The sheet output means outputs the sheet on which the image is formed by the image forming means from one side of the image forming apparatus to the sheet stack means. The post-processing means executes post-processing on the sheet on which the image is formed by the image forming means, and is provided adjacent to a lateral side of the image forming means at an upstream side of the sheet output means. A sheet subjected to post-processing by the post-processing means is output to the sheet stack means from the same direction as a sheet not subjected to post-processing by the post-processing means.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
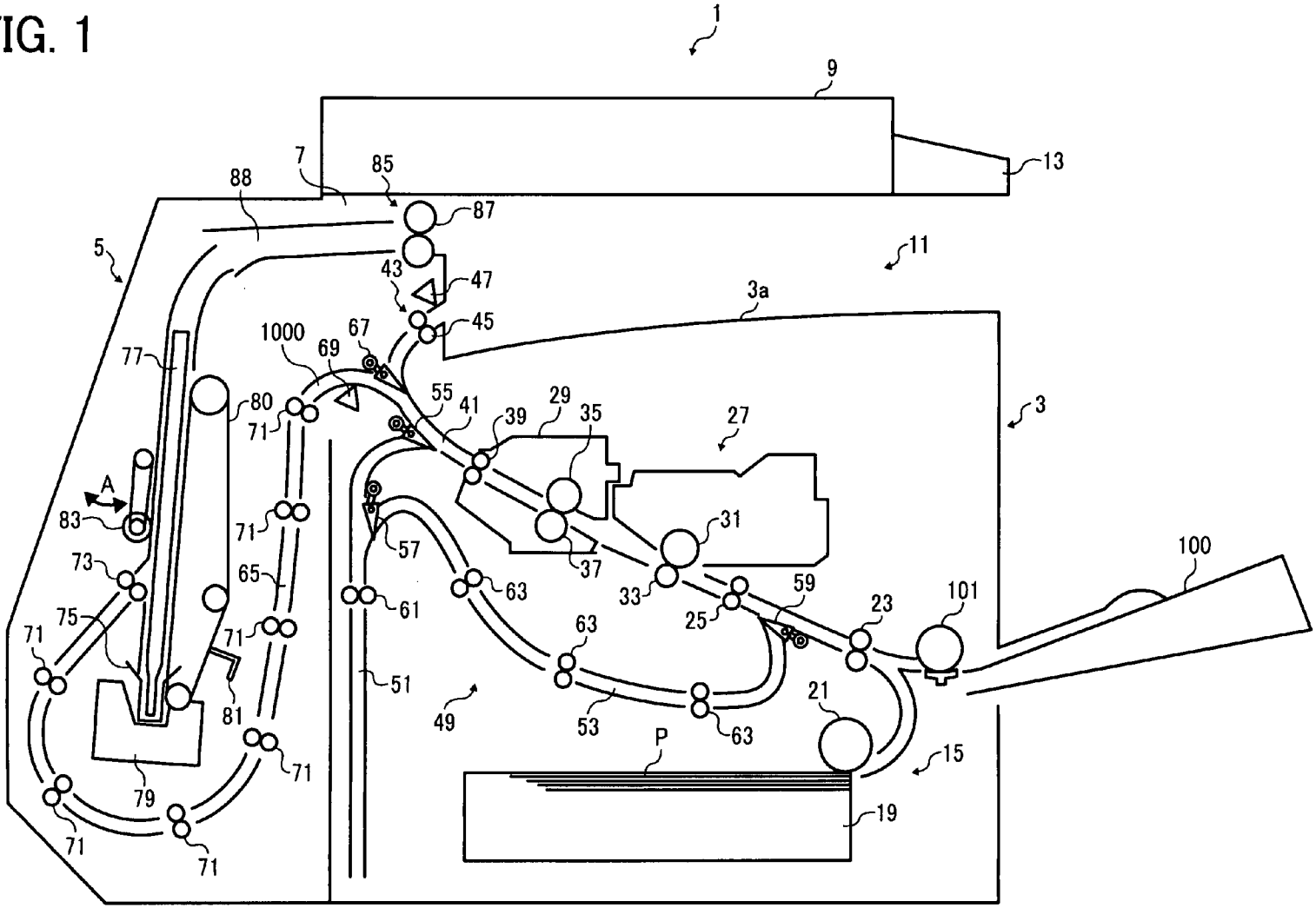
FIG. 1 is a schematic view illustrating a configuration of an image forming apparatus according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Below, illustrative embodiments are described with reference to the drawings. First, to facilitate understanding of the disclosure, structure and operation of an image forming apparatus according to an illustrative embodiment are described with reference to FIGS. 1 and 2.

As illustrated in FIG. 1, an image forming apparatus 1 according to the present illustrative embodiment includes an apparatus body 3 serving as an image forming section and a post-processing unit 5 serving as a post-processing section integrally or detachably mounted at one side, for example, a rear side (opposite to an operation side) of the apparatus body 3.

An image reading unit 9 is mounted on an upper portion of the apparatus body via pillars 7, which serve as a spacer located at an upper face of the rear side of the apparatus body 3. A housing-internal space 11 is formed between the bottom face of the image reading unit 9 and the upper face of the apparatus body 3. The housing-internal space 11 serves as a space for stacking sheets, and the upper face of the apparatus body 3 serves as a sheet stack portion 3*a*.

A sheet stacked on the sheet stack portion 3*a* can be picked up from the front side (operation side) of the apparatus body 3 or from an opening portion formed at a lateral side adjacent to the front side.

A control panel 13 is provided at the front side of the image reading unit 9 for controlling the operation of the image forming apparatus 1.

An openably closable manual feed tray 100 is provided at the front side of the apparatus body 3. A sheet on the manual feed tray 100 is fed into the image forming apparatus 1 using a sheet feed roller 101.

Within the apparatus body 3, a sheet feed unit 15 is provided at a lower portion of the apparatus body 3, and an image forming unit 27 and a fixing device 29 are provided at an upper portion of the apparatus body 3. The sheet feed unit 15 includes a sheet feed tray 19 to stack and store sheets P and a sheet feed roller 21 to feed the sheets. P sheet by sheet. The sheet P fed from the sheet feed tray 19 is transported using a transport roller pair 23. After a registration roller pair 25 corrects skew of the sheet P fed from the sheet feed tray 19, the sheet is transported to a transfer position of the image forming unit 27 at a certain timing.

The image forming unit 27 includes a photoconductor drum 31 serving as an image bearing member and a transfer roller 33 serving as a transfer device.

The photoconductor drum 31 is surrounded by, for example, a charging device, an exposing device, a developing device, a cleaning device, a discharging device, and so on. In the image forming unit 27, an electrostatic latent image is formed on the photoconductor drum 31 and developed into a visible toner image. The transfer roller 33 electrostatically transfers the toner image onto the sheet P transported to the transfer roller 33 at the certain timing.

The fixing device 29 includes a fixing roller 35 and a pressure roller 37 to fix the toner image on the sheet P by heating and melting the toner. After the fixing process, the sheet P is transported in the downstream direction using a fixing output roller pair 39.

The sheet P fed from the sheet feed unit 15 is transported through a first transport path 41. At a downstream portion of the first transport path 41 is provided a first sheet output unit 43. In an image formation mode not including post-processing, image formation is executed on sheets P in turn from a first page, and the sheets P are output to the sheet stack portion 3*a* in page order and face down.

The first sheet output unit 43 also includes an output roller pair 45 to output the sheet P and a sheet sensor 47 serving as a sheet detecting device to detect the sheet P.

A sheet reverse unit 49 includes a reverse transport path 51 branching from the first transport path 41 at a downstream portion near the fixing device 29 and extending downward along a side face of the apparatus body 3 and a re-feed transport path 53 branching from an upper portion of the reverse transport path 51 and merging with the first transport path 41 at an upstream side of the registration roller pair 25.

A first switching claw 55 is provided at a branching portion between the first transport path 41 and the reverse transport path 51. A second switching claw 57 is provided at a branching portion between the reverse transport path 51 and the re-feed transport path 53. A third switching claw 59 is provided at a merging portion between the re-feed transport path 53 and the first transport path 41.

In duplex mode, when image formation is performed on one face of the sheet P, the sheet P is guided to the reverse transport path 51 using the switching claw 55 and transported using a transport roller pair 61. The sheet P is held substantially vertically in the reverse transport path 51, and guided into the re-feed transport path 53 using the switching claw 57.

The sheet P is transported through the re-feed transport path 53 using transport roller pairs 63, sent into the first transport path 41 using the switching claw 59, and re-fed to the transfer position of the image forming unit 27.

After image formation is executed on the back face of the sheet P, the sheet P is transported into the re-feed transport path 53 again and turned over so that odd-numbered pages are output to the sheet stack portion 3*a* face down.

In this regard, after image formation on the back face of the sheet P, the sheet P may be directly transported to the first sheet output unit 43 without being transported to the re-feed transport path 53. In this case, instead of performing image formation on sheets P in turn from a first page, images of even-numbered pages are formed on the front faces of the sheets P while images of odd-numbered pages are formed on the back faces of the sheets P. Thus, the odd-numbered pages of the sheets P can be output to the sheet stack portion 3*a* face down.

In the image formation mode of the sheets P including post-processing, the sheet P is transported to the post-processing unit 5 via a second transport path 65 branching from the first transport path 41 at a downstream portion near the switching claw 55. A fourth switching claw 67 is provided at a branching portion between the first transport path 41 and the second transport portion 65. The switching claw 67 serves as a sheet switching member to switch the transport direction of the sheet P between the first transport path 41 and the second transport path 65.

Near the switching claw 67 is provided a sheet sensor 69 to detect the sheet P guided to the second transport path 65. The transport amount and position of sheet P in the post-processing unit 5 can be detected based on detection signals of the sheet sensor 69.

In the present illustrative embodiment, the post-processing unit 5 performs stapling as one type of post-processing operation. In this regard, it is to be noted that the post-processing unit 5 may perform punching, sealing, or sorting as such post-processing, and moreover, for example, punching and stapling may be combined together.

The sheet P guided to the second transport path 65 is transported using a plurality of transport roller pairs 71, and a transport roller pair 73 outputs the sheet P to the sheet handling tray 75 serving as a sheet alignment portion.

The second transport path 65 is curved to turn the sheet P over without switching the transport direction of sheet P. As a result, a plurality of sheets P is stacked on the sheet handling tray 75 face down, so that the plurality of sheets P is stacked in page order. At this time, as in the case in which a sheet P is output to the sheet stack portion 3*a*, after an image is formed on the face of the sheet P, the sheet P is placed on the sheet handling tray 75 with the face having the image face down. Accordingly, the plurality of sheets P can be sorted in page order without printing the sheets P from the last page using one-side memory function, thereby increasing productivity.

For a post-processing operation involving staple binding, as is the case conventionally the sheets P are stacked in turn on the sheet handling tray 75. At this time, the rear (lower) end of each sheet P is abutted against a rear end fence, which is the bottom face of the sheet handling tray 75. As a result, the sheets P are aligned in the sheet transport direction using a tap roller 83 and in a direction perpendicular to the sheet transport direction using a jogger fence 77.

When the sheets P for one process are stacked and aligned, a stapler 79 staples the sheets P. In this regard, since a trailing end of the sheet stack is stapled, the exposing device forms a 180-degree rotated latent image on the photoconductor drum 31.

The bundle of stapled sheets is discharged to a second sheet output unit 85 using an output hook (discharge hook) 81 located on the outer circumferential surface of a discharge belt 80.

The tap roller 83 is provided so as to be pivotable in directions indicated by a double arrow A of FIG. 1, and has a function for sending the sheets P, transported to the sheet handling tray 75, back in a downward direction to align the lower ends of the sheets P.

At a downstream portion of the second transport path 65 is provided the second sheet output unit 85 to output the sheets P subjected to image formation including post-processing to the sheet stack portion 3*a*. The second sheet output unit 85 serves as an output port separately provided with a gap from the first sheet output unit 43 in a sheet stack direction of the sheet stack portion 3*a*. An output roller pair 87 is provided at the second sheet output unit 85.

When a precedent sheet not subjected to post-processing is previously placed on the sheet stack portion 3*a*, a subsequent sheet subjected to post-processing is placed over the sheet.

As described above, since the second transport path 65 is curved to turn the sheet P over without switching the transport direction of sheet P, the sheet P can be turned over without using a configuration for switch-back transport, resulting in excellent productivity.

Further, the second transport path 65 is formed without crossing a post-post-processing transport path 88 to output the sheet P from the sheet handling tray 75 via the second sheet output unit 85 to the sheet stack portion 3*a*. Accordingly, the image forming apparatus 1 is capable of stacking sheets on the sheet handling tray 75 in parallel with outputting both a sheet not subjected to post-processing and a sheet subjected to post-processing, resulting in excellent productivity.

Figure 2:
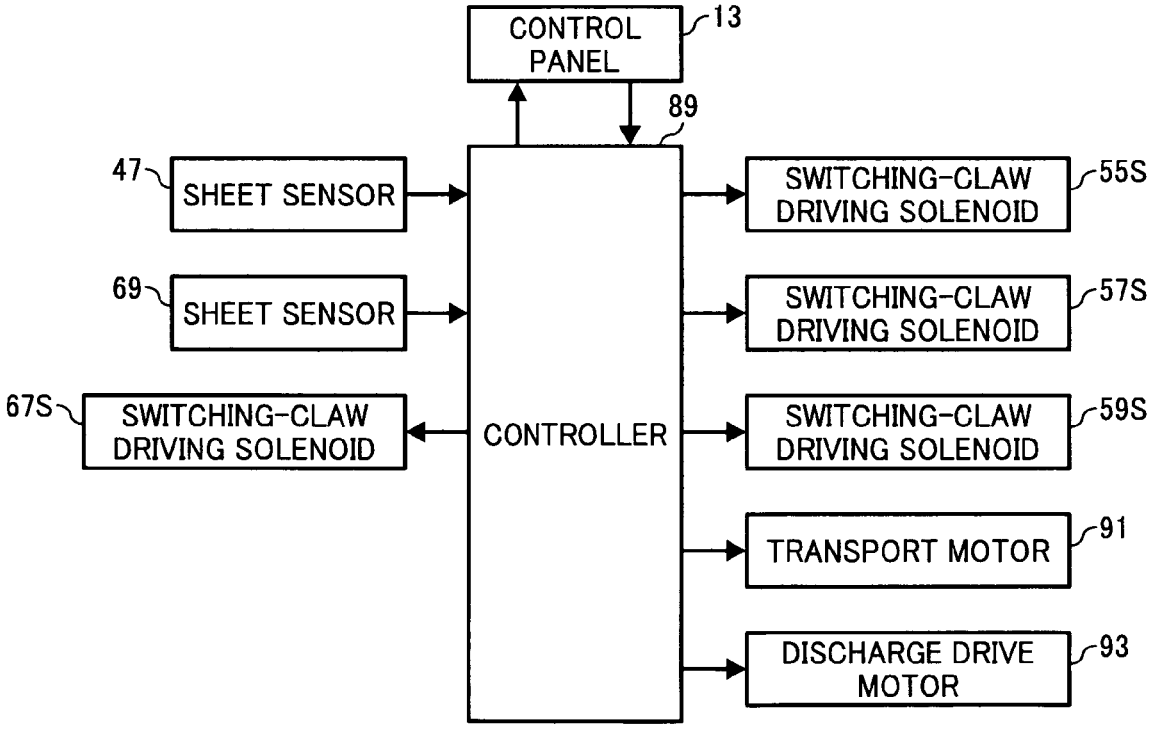
FIG. 2 is a control block diagram illustrating a control system according to an illustrative embodiment.

FIG. 2 is a block diagram showing a control system according to an illustrative embodiment.

Operation of the image forming apparatus 1 is controlled by a controller 89. The controller 89 may be a micro-computer including a CPU (central processing unit), ROM (read-only memory), RAM (random access memory), I/O (input-and-output) interface, and other components. The controller 89 controls, for example, switching claw drive solenoids 55S, 57S, 59S, and 67S that drive switching claws 55, 57, 59, and 67, respectively, a transport motor 91 that drive the transport roller pairs 71 and other components, and a discharge drive motor 93 that drives the output hook 81.

In this illustrative embodiment, the post-processing unit 5 is provided at a lateral side of the apparatus body 3, thereby suppressing an increase in the height of the image forming apparatus 1. In other words, since the post processing unit 5 is not located within the housing-internal space 11, the housing-internal space 11 can be used as a sheet output space, thereby providing a sufficient capacity for output sheets.

In this illustrative embodiment, the sheet handling tray 75 is located obliquely below the first sheet output unit 43. Alternatively, in another illustrative embodiment, the sheet handling tray 75 may be located so that the upper end of the sheet handling tray 75 is positioned higher than the first sheet output unit 43 to form a space between the lower end of the second transport path 65 and the bottom face (floor face) of the apparatus body 3. In such a configuration, the second transport path 65 is openable from the bottom side of the apparatus body 3, thereby facilitating clearing of jammed sheets.

Figure 3:
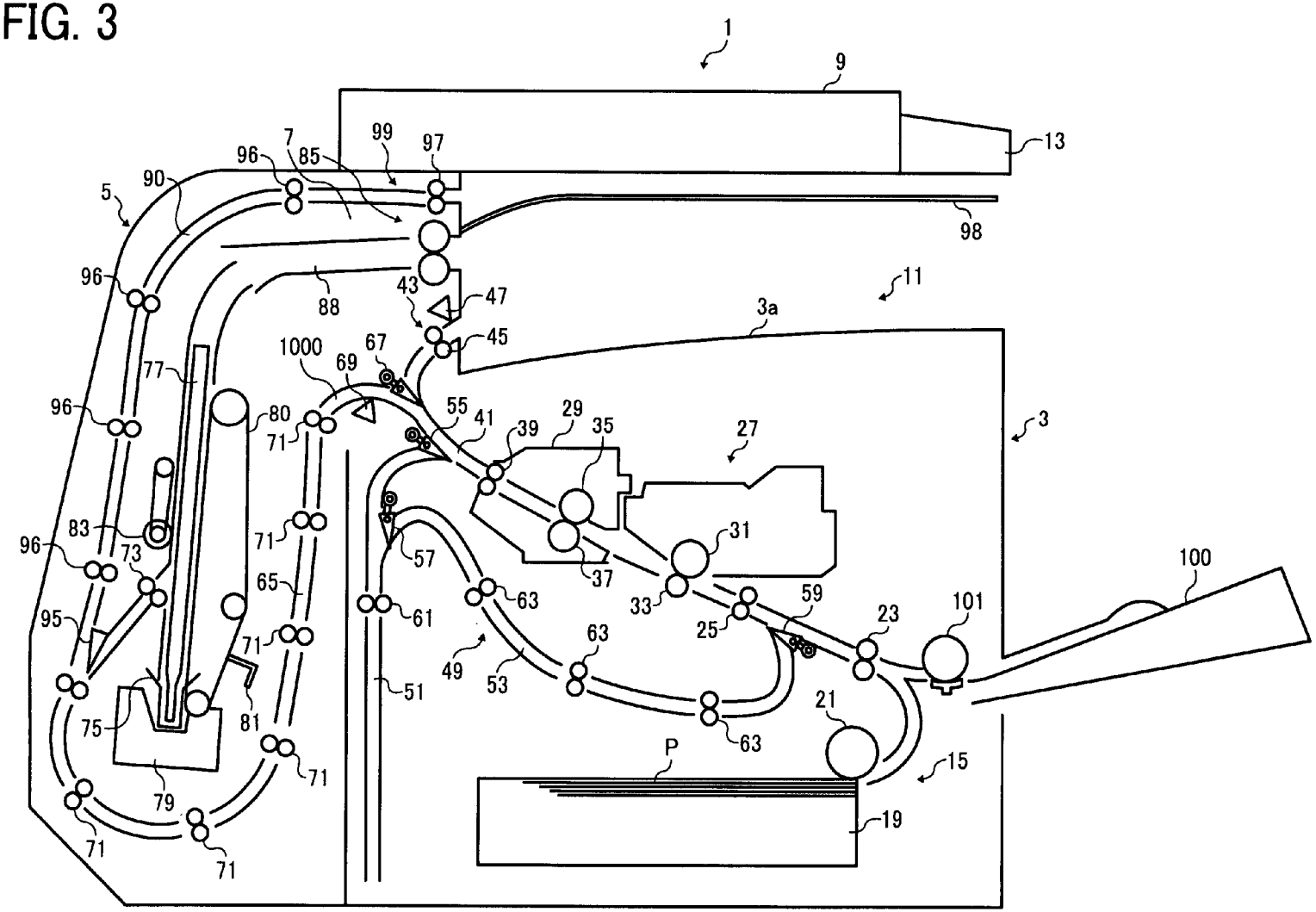
FIG. 3 is a schematic view illustrating another configuration of an image forming apparatus according to an illustrative embodiment.

Next, another illustrative embodiment is described with reference to FIG. 3. The same components as those of the above-described embodiments are represented by the same reference numerals. Redundant descriptions of the configurations and functions thereof are omitted unless particularly needed, and only relevant portions thereof are described below.

A distinctive feature of this illustrative embodiment is that another sheet stack portion for loading a sheet such as a facsimile sheet, which a user does not want to mix with other types of sheets, is separately provided at a housing-internal space 11.

In this illustrative embodiment, a post-processing unit 5 includes a post-processing bypass transport path 90 branching from a second transport path 65 near a sheet handling tray 75 and extending to a sheet stack portion 98 without passing through the sheet handling tray 75.

A switching claw 95 is provided at a branching portion between the post-processing bypass transport path 90 and the second transport path 65, and operated so that a sheet is selectively guided to either the sheet handling tray 75 or the post-processing bypass transport path 90. The switching claw 95 is driven by a switching claw driving solenoid controlled by a controller 89.

The sheet guided to the post-processing bypass transport path 90 is transported using transport roller pairs 96 and output, using an output roller pair 97, from a third sheet output unit (bypass sheet output unit) 99 to a second sheet stack portion 98 formed at an upper portion of a second sheet output portion 85 between the sheet stack portion 3*a* and an image reading unit 9.

In this case, since the sheet passes through the second transport path 65, it takes a longer time to transit than when the sheet is output from a first sheet output portion 43. Meanwhile, such configuration can prevent different types of sheets from being interleaved on the sheet stack portion 3*a*, facilitating retrieval of one type of sheet, such as a facsimile sheet, separately from other types of sheets.

Further, since the second sheet stack portion 98 is provided higher than the second sheet output portion 85, the housing-internal space 11 has a sufficient capacity for stacking output sheets without affecting the capacity for stacking sheets output from the second sheet output unit 85.

Figure 4:
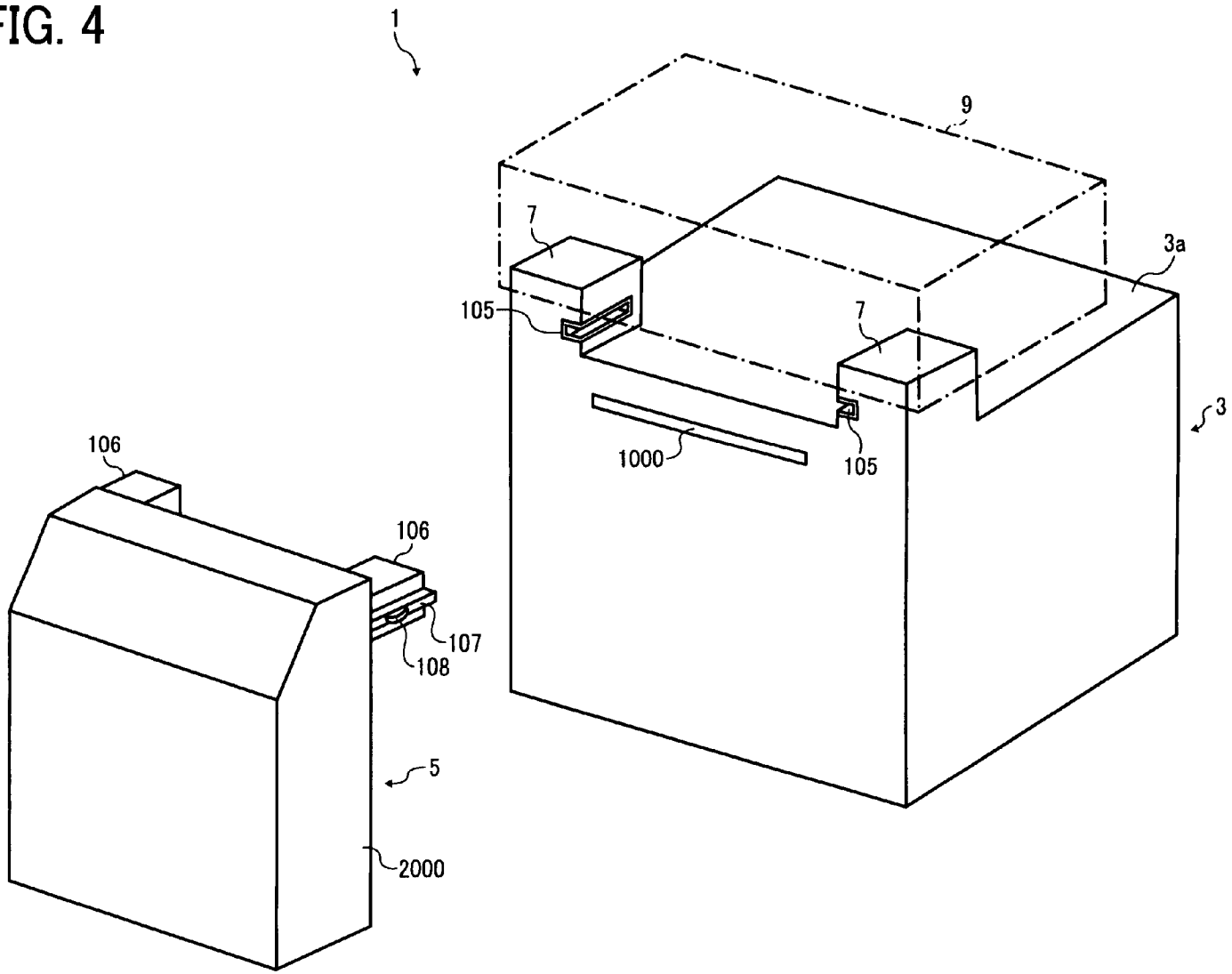
FIG. 4 is a schematic perspective view illustrating a configuration of an image forming apparatus according to an illustrative embodiment, in which a post-processing unit is detached from an apparatus body.

FIG. 4 is a schematic view illustrating an image forming apparatus 1 according to an illustrative embodiment of the present disclosure, in which a post-processing unit 5 is detachably mountable to an apparatus body 3 from the rear side of the image forming apparatus 1.

As illustrated in FIG. 4, the post-processing unit 5 has a substantially 90-degree rotated L-shape including a vertical portion 2000 and horizontal portions 106. The vertical portion 2000 includes the structure from an output port 1000 of the apparatus body 3 to the post-post-processing transport path 88 illustrated in FIG. 1 or 3. Each horizontal portion 106 includes the structure from the post-post-processing transport path 88 to the output roller pair 87 illustrated in FIG. 1 or from the transport roller pair 96 to the output roller pair 97 illustrated in FIG. 3.

Slots 105 are provided in inner lateral sides of pillars 7 located at both sides of an upper rear portion of the apparatus body 3. Each slot 105 is formed with a C-shaped material embedded into the corresponding pillar 7. In the post-processing unit 5, the horizontal portions 106 are provided protruding toward the apparatus body 3 to serve as a mount section mountable to the apparatus body 3 via the slots 105. Specifically, at outer lateral sides of the horizontal portions 106 are formed convex rails 107 serving as positioning members engageable with the slots 105.

A protrusion 108 serving as an engaging portion is provided so as to be retractably projectable from each rail 107. A corresponding engaging concave portion for engaging each protrusion 108 is provided in the apparatus body 3. The protrusion 108 and the engaging concave portion are relatively positioned between the post-processing unit 5 and the apparatus body 3.

When the post-processing unit 5 is mounted to the apparatus body 3, the protrusions 108 engage the engaging concave portions and lock automatically, so that the output port 1000 of the apparatus body 3 is physically connected to the transport path of the post-processing unit 5. In this regard, in the above-described illustrative embodiment illustrated in FIG. 3, the post-processing unit 5 may be mounted to the apparatus body 3 with the second sheet stack portion 98 mounted at the horizontal portions 106, thereby increasing operability compared to when the second sheet stack portion 98 is mounted to the horizontal portions 106 within the limited space of the housing-internal space 11.

Meanwhile, when the post-processing unit 5 is detached from the apparatus body 3, the protrusions 108 are retracted into the rails by a lock release mechanism. Detaching the post-processing unit 5 allows a user to fix jams from the output port 1000. In addition, a configuration in which the reverse transport path 51 is openable with a back cover of the apparatus body 3 allows a user to fix sheet jams in the reverse transport path 51.

Such mounting and detaching configurations are similarly applicable to all the above-described illustrative embodiments.

In the above-described illustrative embodiment of FIG. 1, the front face of the apparatus body 3 is located at the right side of FIG. 1, the control panel 13 is provided above the right side of the sheet stack portion 3*a*, and stacked output sheets are picked up from the right side of FIG. 1. Meanwhile, it is to be noted that the configuration of the image forming apparatus is not limited to such a configuration.

For example, the front face of the apparatus body 3 may be located at the front side of FIG. 1 so that the control panel 13 is located at the front side of FIG. 1, and stacked output sheets may be picked up from the front side of FIG. 1. In such a case, even in a housing-internal output-type image forming apparatus that outputs sheets in a horizontal direction, a sheet having passed through a post-processing unit is output to a housing-internal sheet stack portion 3*a*. Accordingly, it is not necessary to provide another sheet stack portion at the left side of the post-processing unit 5 illustrated in FIG. 1, thereby saving space.

Next, an illustrative embodiment of the present disclosure is described with reference to FIG. 5.

Figure 5:
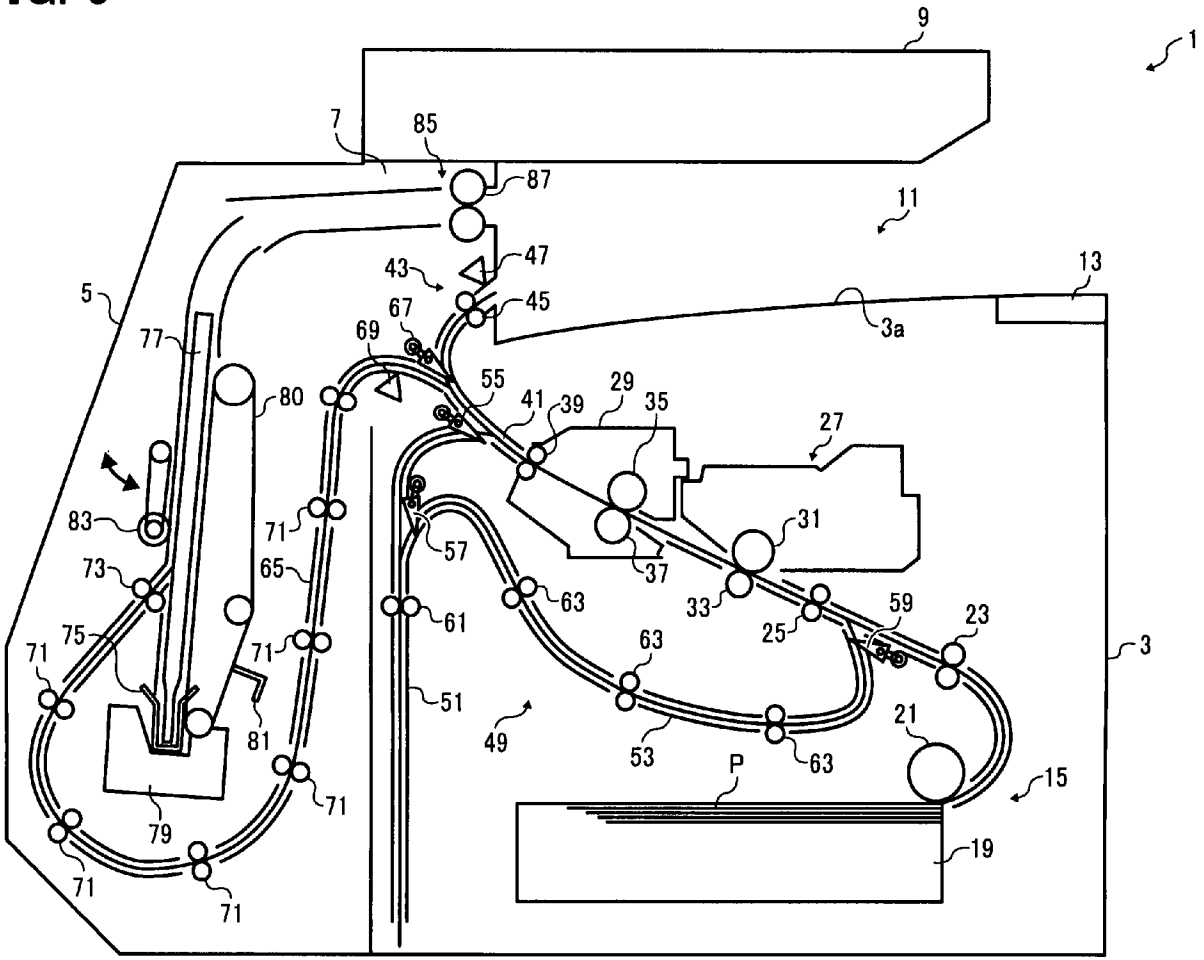
FIG. 5 is a schematic view illustrating yet another configuration of an image forming apparatus according to an illustrative embodiment.

In FIG. 5, an image forming apparatus 1 according to the present illustrative embodiment has substantially the same configuration as that of the above-described illustrative embodiment illustrated in FIG. 1 except that in FIG. 5 a control panel 13 is provided at the front side (operation side) of a sheet stack portion 3*a* of an apparatus body 3 and a manual feed tray 100 and a sheet feed roller 101 are not provided. Therefore, the same components as those of the above-described embodiments are represented by the same reference numerals, and redundant descriptions of the configurations and functions thereof are omitted here.

Further, the image forming apparatus 1 illustrated in FIG. 5 may include the control system illustrated in FIG. 2.

Below, taking the image forming apparatus 1 illustrated in FIG. 5 as an example, an operation flow of interruption processing according to a conventional control method is described with reference to FIGS. 6A to 6H.

For image forming apparatuses, different types of interruption processing are proposed to improve productivity or user convenience. FIGS. 6A to 6H show a flow of operations per certain interval in a conventional control method when image formation including post-processing is interrupted by image formation not including post-processing.

For descriptive convenience, the transport speed in image formation of the apparatus body 3 and the transport speed of the post-processing unit 5 are assumed to be constant. In addition, the post-processing time is assumed to include the time for transporting a bundle of sheets to the post-processing-side output port (the second sheet output portion 85). Three sheets for interrupt processing are designated as a-1, a-2, and a-3, and sheets for interrupted post-processing (staple two-sheet binding) transported after restart are designated in turn as b-1, b-2, b'-1, b'-2, b"-1, and b"-2.

Figure 6A:
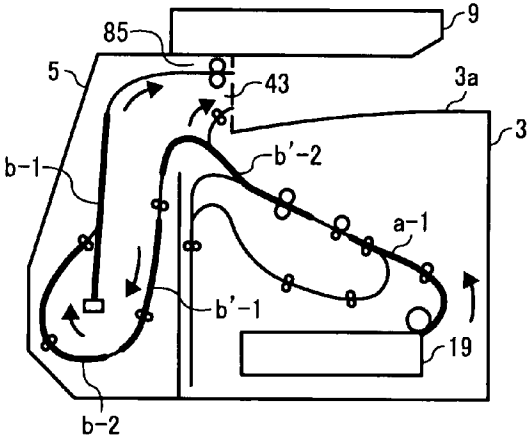
FIGS. 6A to 6H are schematic views illustrating a flow of operations when the image forming apparatus illustrated in FIG. 5 executes a conventional control method.

FIG. 6A shows a state in which, after images are formed on the sheets b-1, b-2, b'-1, and b'-2 during image formation including post-processing, interrupt processing (image formation not including post-processing) is executed and the first sheet a-1 for the interrupt processing is fed from the sheet feed tray 19.

Figure 6B:
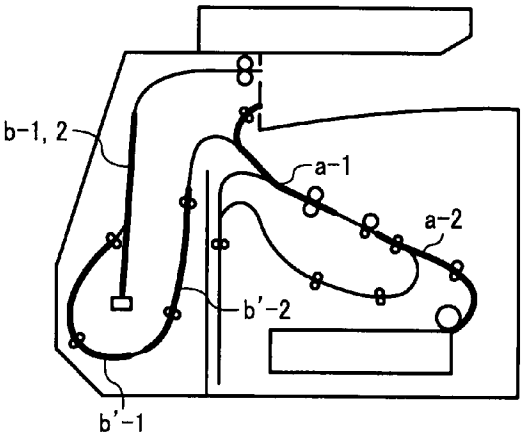

FIG. 6B shows a state in which the sheets b-1 and b-2 for image formation including post-processing are stacked on the sheet handling tray 75 to be ready for binding. In FIG. 6B, the sheet a-1 for interrupt processing is transported to a position just before being output to the sheet stack portion 3*a*, while the sheet a-2 for interrupt processing is fed from the sheet feed tray 19.

Figure 6C:
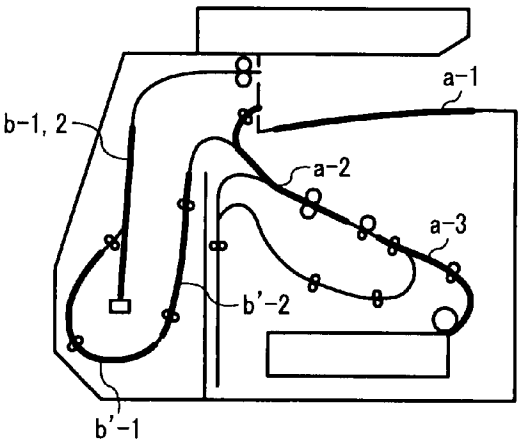

In the post-processing unit 5, a bundle of the sheets b-1 and b-2 bound by post-processing is held at the sheet handling tray 75, and in the meantime, interrupt processing continues. FIG. 6C shows a state in which the sheet a-1 is output onto the sheet stack portion 3*a*, the sheet a-2 is transported to a position just before being output to the sheet stack portion 3*a*, and the sheet a-3 is fed from the sheet feed tray 19.

Figure 6D:
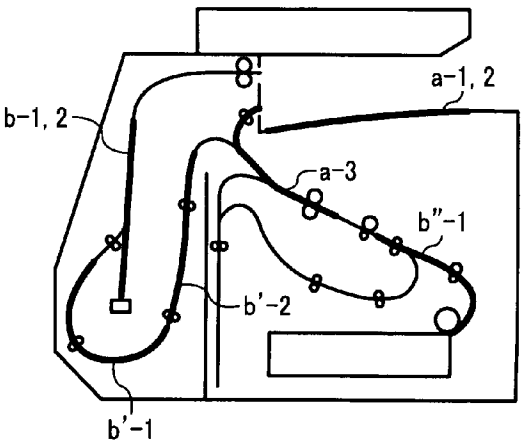
Figure 6E:
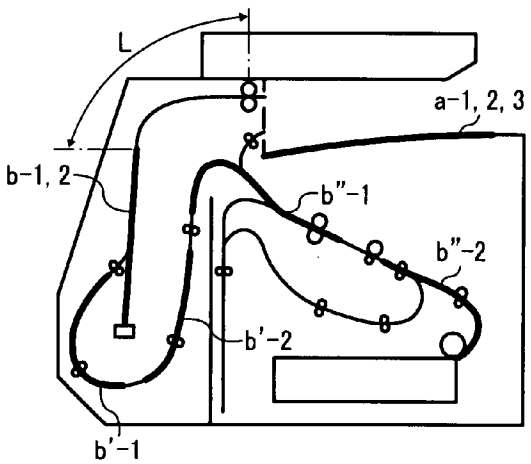
Figure 6F:
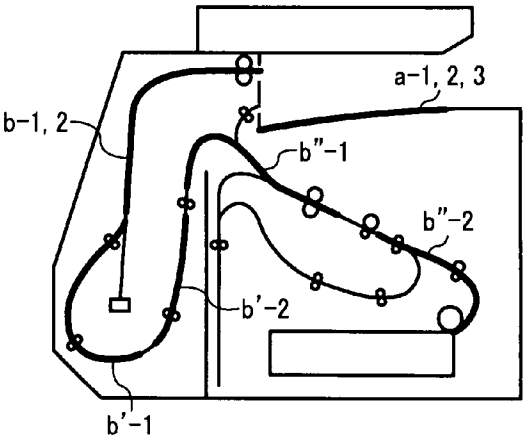

FIG. 6D shows a state in which the sheets a-1 and a-2 are output onto the sheet stack portion 3*a*, the sheet a-3 is transported to a position just before being output to the sheet stack portion 3*a*, and the sheet b"-1 for the image formation including post-processing is fed from the sheet feed tray 19. When all the sheets a-1, a-2, and a-3 for the interrupt processing are output as illustrated in FIG. 6E, the image formation including post-processing is restarted as illustrated in FIG. 6F. The bound sheets b-1 and b-2 held at the sheet stack tray 75 are transported (pushed up) toward the second sheet output portion 85 using a discharge claw 81, while the sheet b"-2 is fed from the sheet feed tray 19.

Figure 6G:
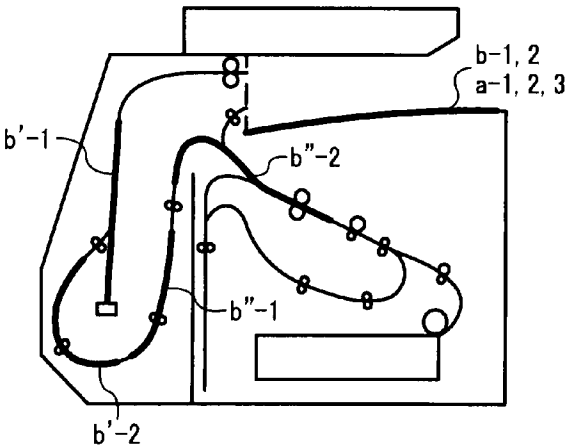
Figure 6H:
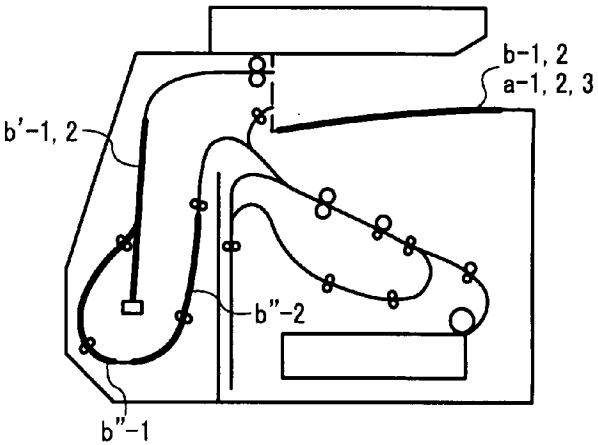

FIG. 6G shows a state in which the bound sheets b-1 and b-2 are output on top of the sheets a-1, a-2, and a-3, and the sheet b'-1 is stacked on the sheet handling tray 75. Subsequently, when the sheet b'-2 is stacked on the sheet handling tray 75, the sheets b'-1 and b'-2 are bound as illustrated in FIG. 6H.

In the conventional control method, as illustrated in FIG. 6A to 6E, the sheets for interrupted processing are held at the sheet stack tray 75 serving as a sheet alignment portion until all the sheets (in this example, a-1, a-2, and a-3) for interrupt processing are output.

Since there is a distance L between the sheet stack tray 75 and the second sheet output portion 85 as illustrated in FIG. 6E, such configuration needs time for transporting the bundle of sheets over the distance L between restart of the interrupted processing (image formation including post processing) and output of the sheets.

By contrast, as described above, a conventional image forming apparatus having a plurality of trays executes image formation not including post-processing in parallel with image formation including post-processing to output respective sheets into separate trays. However, if such a control method is applied to the image forming apparatus 1, the respective sheets are output to the identical housing-internal tray (the sheet stack portion 3*a*). Depending on output timing, the respective sheets may be simultaneously output from the respective output ports (the first sheet output portion 43 and the second sheet output portion 85). Consequently, one output operation may prevent the other output operation, resulting in a sheet jam.

To cope with such conventional failure, in the present illustrative embodiment, the following control method is employed. That is, when image formation including post-processing is interrupted by image formation not including post-processing, the post-processing in the post-processing unit 5 is executed in parallel with the image formation not including post-processing. Sheets for the image formation including post processing are held or stop at the second sheet output portion 85 until a trailing end of the last sheet for interrupt processing of the image formation not including post-processing is detected.

FIGS. 7A to 7H show a flow of operations of the image forming apparatus 1 of FIG. 5 when the above-described control method is executed under the same conditions and timing as those of FIGS. 6A to 6H. Below, redundant descriptions for operations similar to those in FIGS. 6A to 6H are omitted, and only relevant portions are described.

Figure 7A:
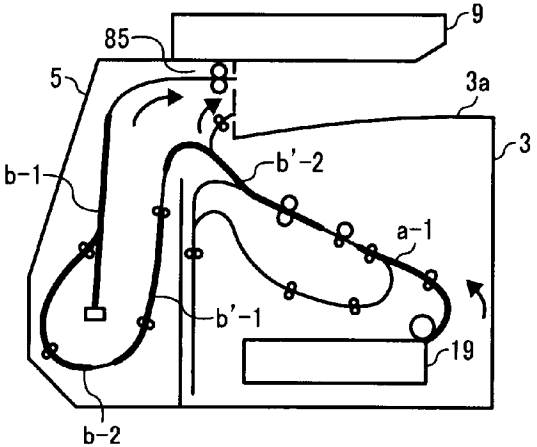
FIGS. 7A to 7H are schematic views illustrating a flow of operations when the image forming apparatus illustrated in FIG. 5 executes a control method according to an illustrative embodiment.
Figure 7B:
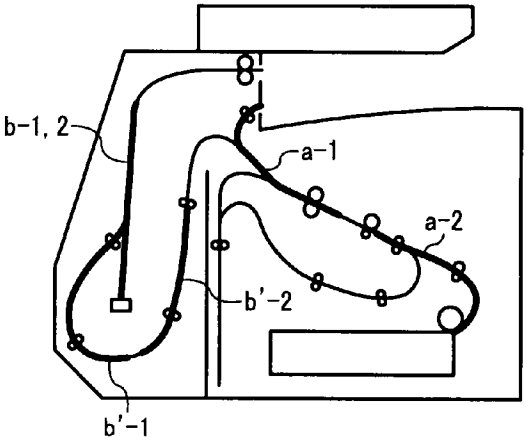
Figure 7C:
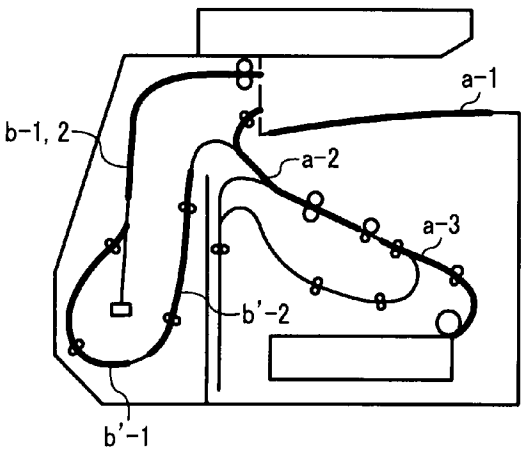

In the present illustrative embodiment, as illustrated in FIG. 7C, when a sheet a-1 for interrupt processing is output to the sheet stack portion 3*a*, a bundle of sheets b-1 and b-2 having been subjected to post-processing is transported to the second sheet output portion 85 using the discharge claw 81, and held at the second sheet output portion 85.

Figure 7D:
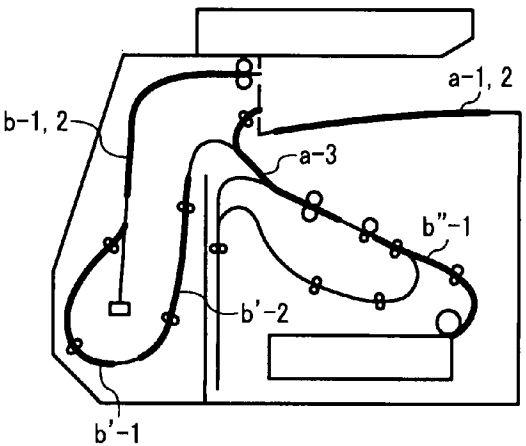
Figure 7E:
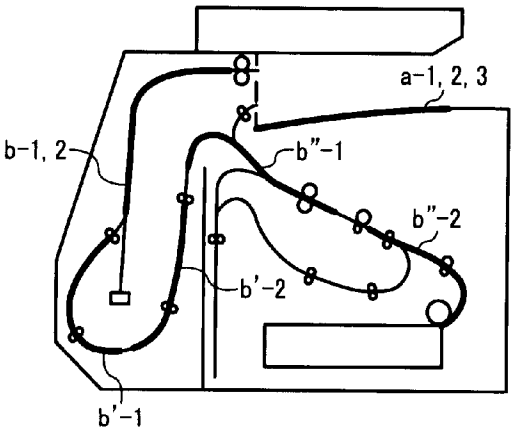

While the bundle of sheets b-1 and b-2 is held, interrupt processing is going on as illustrated in FIG. 7D. When a last sheet a-3 for the interrupt processing is output to the sheet stack portion 3*a* and the sheet sensor 47 detects the trailing end of the sheet a-3, the transport motor 91, the discharge drive motor 93, and so on are rotated to restart the image formation including post-processing as illustrated in FIG. 7E.

Figure 7F:
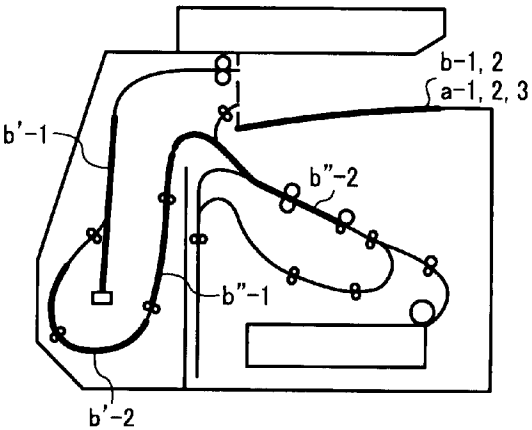
Figure 7G:
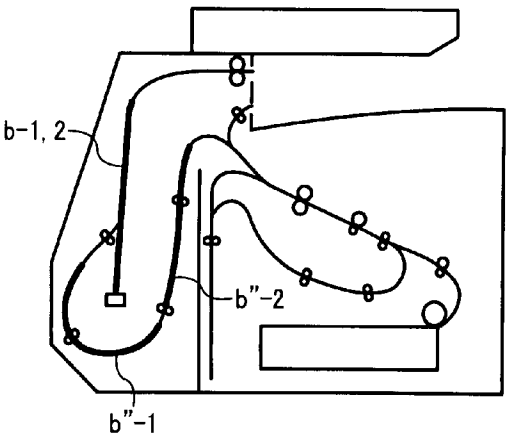
Figure 7H:
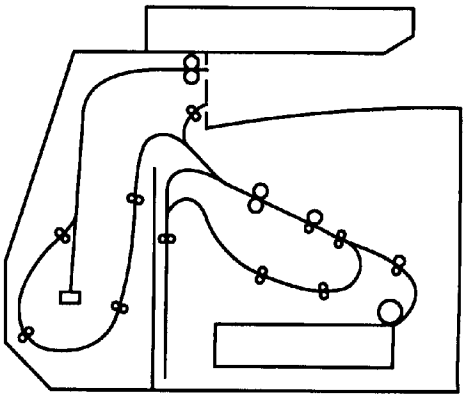

In this case, as illustrated in FIG. 7F, the bundle of sheets b-1 and b-2 held at the second sheet output portion 85 is output to the sheet stack portion 3*a* nearly simultaneously with the restart of the image formation including post-processing. That is, in the present illustrative embodiment, at a timing of the sixth step illustrated in FIG. 7F, the image formation including post-processing is restarted from sheet output operation. By contrast, in the conventional control method illustrated in FIGS. 6A to 6H, the image formation including post-processing is restarted from sheet output operation at a timing of the seventh step illustrated in FIG. 6G. Accordingly, the control method according to the present illustrative embodiment can reduce the time required for transporting the bundle of sheets over the distance L to six-sevenths of the time required in the conventional arrangement.

For descriptive simplicity it is assumed that the transport speed during image formation and the transport speed in the post-processing unit 5 are constant. The post-processing time includes the time required for transporting a bundle of bound sheets to the post-processing-side output port (the second sheet output portion 85). Three sheets for interrupt processing are designated as a-1, a-2, and a-3, and sheets for interrupted post processing (staple two-sheet binding) transported after restart are designated in turn as b-1, b-2, b'-1, b'-2, b"-1, and b"-2.

In this regard, even if the transport speed in image formation and the transport speed in the post-processing unit 5 are different, or the number of sheets in the interrupt processing and interrupted processing are different, a similar time loss may be generated after restart since the sheet bundle is held at a sheet alignment position (the sheet handling tray 75). In such a case, the above-described control method can shorten the time loss.

Figures 8, 8A:
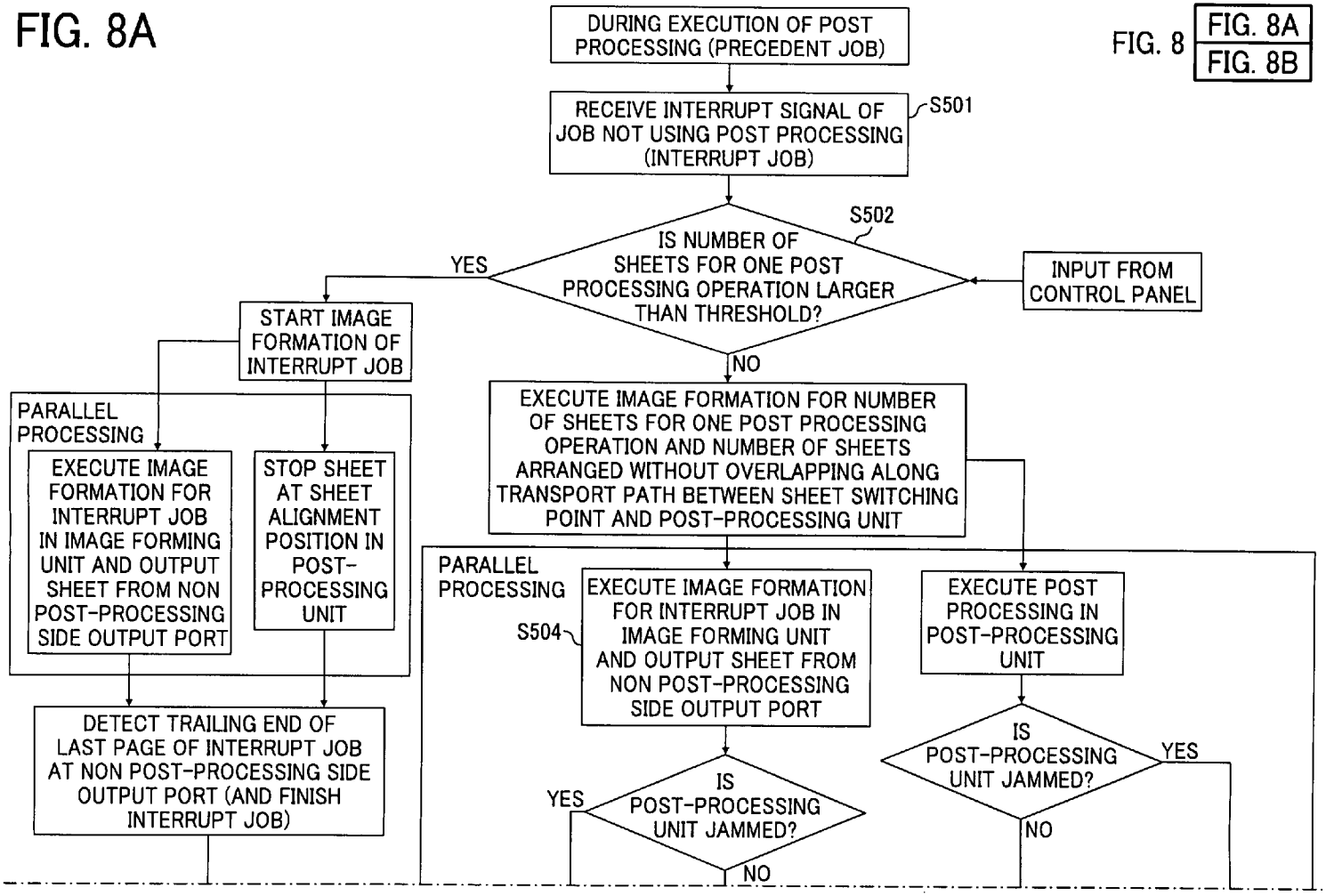
FIGS. 8A and 8B are a flowchart illustrating a control procedure of operations according to an illustrative embodiment.
Figure 8B:
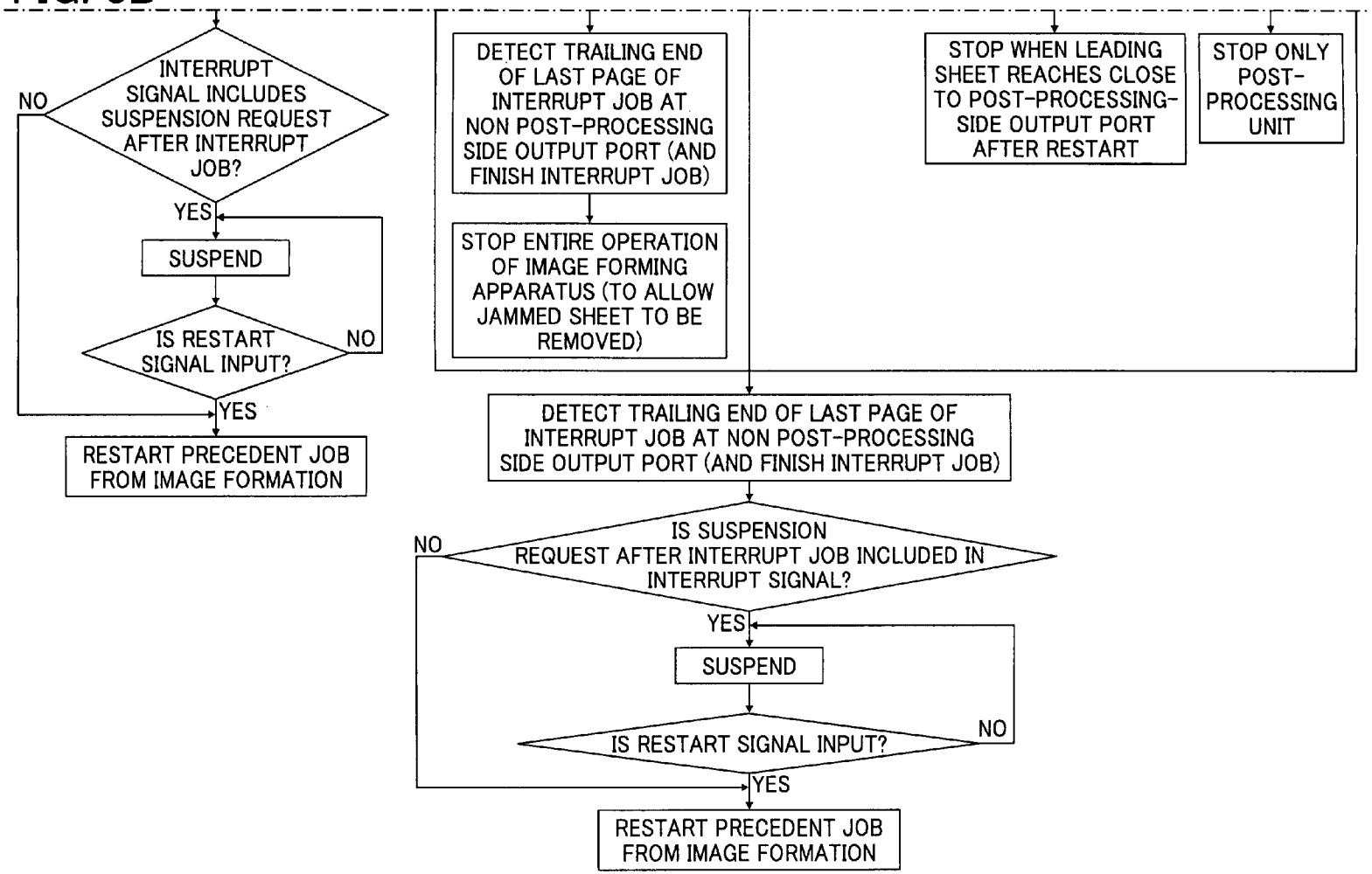

FIGS. 8A and 8B are a flowchart illustrating a control procedure according to the control method described above. In FIGS. 8A and 8B, the first sheet output unit 43 is described as a non-post-processing-side output port.

As illustrated in FIG. 8A, when an interrupt signal of a job not including post-processing is received during execution of an image forming job (precedent job) including post-processing, the control flow according to this illustrative embodiment is initiated at S501. At this time, in order to securely execute parallel processing in the image forming unit 3 and the post-processing unit 5, it is preferable to execute image formation for a number of sheets for one operation of post-processing ahead of the interrupt job and transport the sheets to the post-processing unit 5.

When the job restarted after the interrupt job includes two or more post-processing operations, it is preferable to execute image formation for a number of sheets to be arranged without overlapping at a proper distance away from each other along the transport path between the sheet switching point to the second transport path 65 (the position of the switching claw 67) and the post-processing portion (the sheet handling tray 75) and then transport the sheets to the post-processing unit 5. Such control allows post-processing to be executed consecutively from the first operation thereof.

Thus, after image formation is executed for a number of sheets obtained by adding the number of sheets for one post-processing operation to the number of sheets to be arranged without overlapping at a proper distance from each other along the second transport path 65, the sheets are transported to the post-processing unit 5 and then the image formation not including post-processing is executed.

Figure 9A:
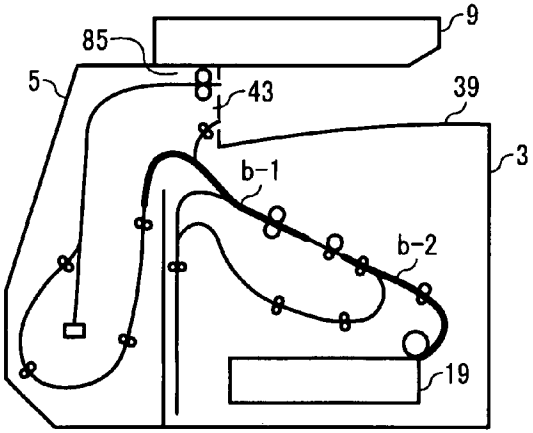
FIGS. 9A to 9H are schematic views illustrating an adverse effect in a control method according to a comparative example in which, before start of interrupt processing, image formation is executed for the number of sheets arranged along a second transport path and the sheets are not transported to a post-processing unit.
Figure 9B:
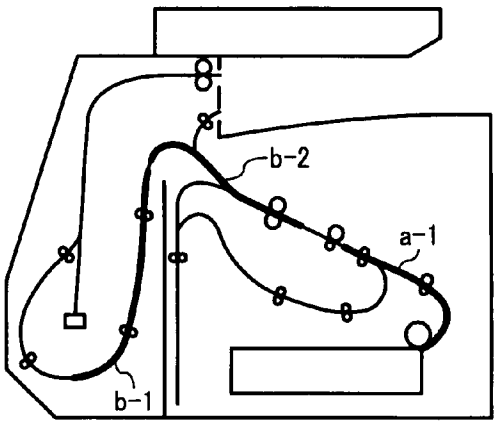
Figure 9C:
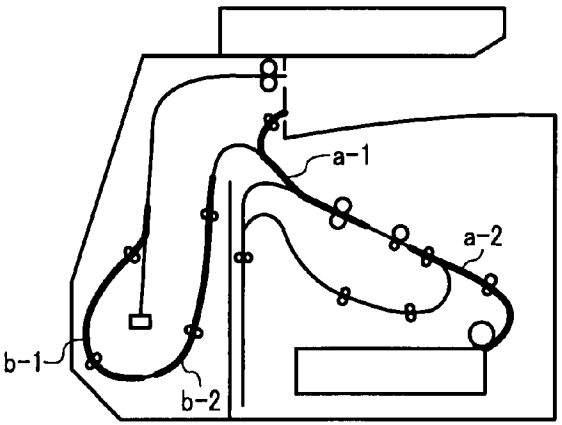
Figure 9D:
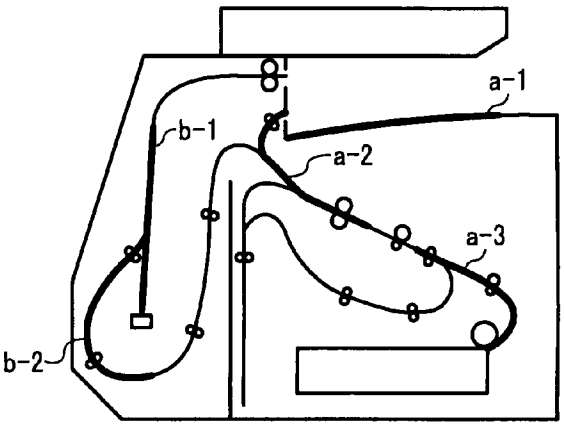
Figure 9E:
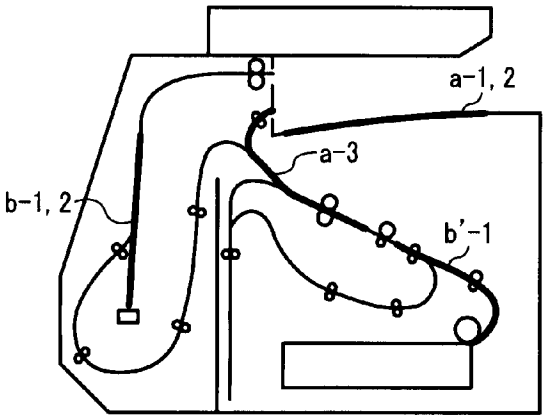
Figure 9F:
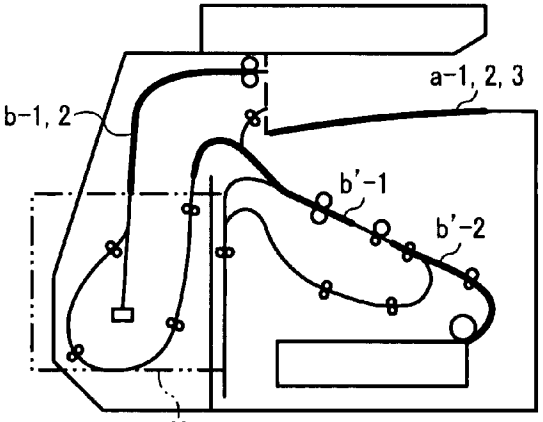
Figure 9G:
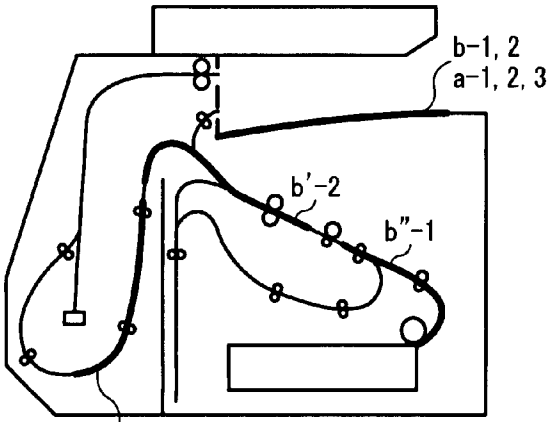
Figure 9H:
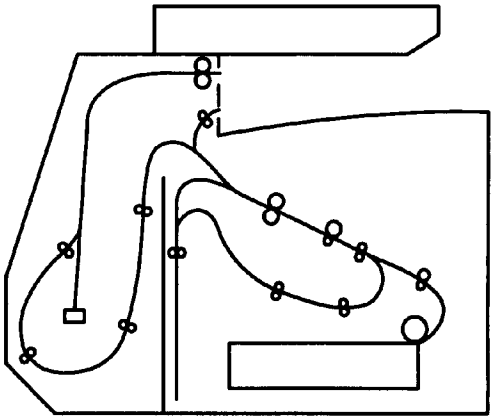

When the job restarted after the interrupt job includes two or more post-processing operations, an operation flow as illustrated in FIGS. 9A to 9G might be considered that, before start of interrupt processing, image formation is executed for the number of sheets to be arranged without overlapping at a certain distance from each other along the transport path between the sheet switching point to the second transport path 65 and the post processing portion (the sheet handling tray 75) while the sheets are not transported to the post processing unit 5. However, in such an operation flow, as illustrated in FIG. 9F, a gap indicated by a space K is generated, resulting in a reduction in productivity.

Further, when the number of sheets requested for one post-processing operation is relatively large, execution of interrupt processing may be delayed. Accordingly, as illustrated in FIG. 8A, it is preferable to store a threshold value for the number of sheets in a storage medium (e.g., the ROM of the controller 89) and determine at S502 to preferentially execute interrupt processing if the number of sheets for one post-processing operation exceeds the threshold value.

If the number of sheets for one post-processing operation exceeds the threshold value, as in the conventional control method sheets subjected to image formation including post-processing are held on the sheet handling tray 75. After an interrupt job (interrupt processing) is finished (the sheet sensor 47 detects the trailing end of the last page of the interrupt job), a precedent job is restarted from image forming operation.

The user may change the threshold value using the control panel 13. Further, a password may be set to deny access to unauthorized users, thereby enhancing security.

If the number of sheets for one post-processing operation does not exceed the threshold value, image formation is executed for the number of sheets for one post-processing operation and the number of sheets that can be arranged without overlapping along the transport path between the sheet switching point to the second transport path 65 and the post-processing point (the sheet handling tray 75). When the transport of the sheets to the post-processing unit 5 is finished, at S504 the image forming unit 3 executes image formation on sheets for the interrupt job, and simultaneously the post-processing unit 5 executes post-processing of the precedent job. The sheets are transported to and held at the second sheet output portion 85. When the sheet sensor 47 detects the trailing end of the last sheet of the interrupt job, the precedent job is restarted from the sheet output operation.

If a sheet jam or other failure occurs in the post-processing unit 5 during execution of parallel processing, only the post-processing unit 5 is stopped while the interrupt processing in the image forming unit 3 may be executed ahead of the post-processing.

If sheet size is identical for both the precedent job and the interrupt job, respective sheets might be intermingled in the single housing-internal tray (the sheet stack portion 3*a*). In such a case, a stop request may be input to the interrupt signal to temporarily stop after the interrupt job. Additionally, the precedent job may be restarted by inputting a restart key through the control panel 13. Such configuration allows a user to restart the precedent job at a desired timing after retrieving the sheets for interrupt processing, thereby enhancing usability.

In the above-described illustrative embodiment, the front side of the apparatus body 3 is located at the right side of FIG. 5. Further, the control panel 13 is provided at the right side of the upper face of the sheet stack portion 3*a*, and output sheets are picked up from the right side of FIG. 5. However, it is to be noted that the image forming apparatus according to the present invention is not limited to such configuration. For example, the front side of the apparatus body 3 may be located at the front side of FIG. 5. The control panel 13 may be provided at the front side of the apparatus body 3, and output sheets may be picked up from the front side of FIG. 5. In such a case, even when the image forming apparatus is a housing-internal output type to output sheets in a horizontal direction, a bundle of sheets having passed the post-processing unit 5 is output to the sheet stack portion 3*a* provided within the housing-internal space of the apparatus body 3. Accordingly, the sheet stack portion 3*a* need not be located at the left side of the post-processing unit 5 in FIG. 5, resulting in space saving.

Illustrative embodiments being thus described, it should be apparent to one skilled in the art after reading this disclosure that the examples and embodiments described herein may be varied in many ways. Such variations are not to be regarded as a departure from the scope of the present invention, and such modifications are not excluded from the scope of the following claims, which are to be accorded the broadest interpretation consistent with the present disclosure.

What is claimed is:

1. An image forming apparatus, comprising:

an image forming unit configured to form an image on a sheet;

a first sheet stack provided at an upper face of the image forming unit, the first sheet stack being a single tray;

a sheet output section including, a first sheet output unit configured to output sheets not subjected to post-processing such that the sheets not subjected to post-processing are output directly to the first sheet stack that is the single tray, and a second sheet output unit configured to output sheets subjected to post-processing directly to the first sheet stack that is the single tray;

a post processing unit provided adjacent to a lateral side of the image forming unit at an upstream side of the sheet output section to execute post-processing on the sheet on which the image is formed by the image forming unit, the post processing unit including, a sheet handling tray configured to, store a plurality of sheets, up to a set capacity, internally in the image forming apparatus in a direction perpendicular to a direction in which the first sheet output unit and the second sheet output unit output the sheets; and align the sheet on which the image is formed therein with the plurality of sheets stored in the sheet handling tray using a pivotable tap roller configured to send the sheet on which the image is formed therein into the sheet handling tray such that the sheet enters the sheet handling tray in the direction perpendicular to the direction in which the first sheet output unit and the second sheet output unit output the sheets, and a discharge belt including a discharge hook located on an outer circumferential surface of the discharge belt, the discharge belt configured to rotate such that the discharge hook carries the sheets subjected to post-processing from the sheet handling tray to the second sheet output unit, and a controller configured to, receive, during execution of an image formation process of sheets to be subjected to post-processing, a first signal generated internally by the image forming apparatus instructing the controller to perform an interruption image formation process that does not include post-processing;

execute, for a first number of sheets, the image forming process of the sheets to be subjected to post-processing, the first number of sheets being less than the set capacity of the sheet handling tray plus a number of sheets that can be arranged along a path between the image forming unit and the second sheet output unit;

transport the first number of sheets to be subjected to post-processing to the post-processing unit and execute post-processing on the first number of sheets to be subjected to post-processing in parallel and simultaneously with the interruption image formation process that does not include post-processing, when the image forming process for the first number of sheets to be subjected to post-processing concludes;

hold the first number of sheets that have been subjected to post-processing at the second sheet output unit until the controller receives a second signal from a second sheet sensor indicating that the interruption image formation process that does not including post-processing is finished; and discharge, using the discharge hook, the first number of sheets that have been subjected to post-processing that are held at the second sheet output unit such that the sheets begin to emerge from the second sheet output unit immediately upon rotation of the discharge belt, wherein the first sheet stack is configured to receive both the sheets subjected to post-processing from the post processing unit and the sheets not subjected to post-processing from the sheet output section.

2. The image forming apparatus according to claim 1, further comprising an image reading unit provided above the image forming unit, wherein the image forming unit and the image reading unit have an internal space formed therebetween and a top surface of the image forming unit is configured to serve as the first sheet stack.

3. The image forming apparatus according to claim 2, wherein a post-processing transport path transports the sheet having the image to the sheet handling tray so as to turn the sheet upside down.

4. The image forming apparatus according to claim 3, wherein the post-processing transport path is curved to turn the sheet upside down without switching a transport direction of the sheet.

5. The image forming apparatus according to claim 4, wherein the post-processing transport path is formed so as not to cross a post-post-processing transport path that outputs the sheet from the sheet handling tray to the first sheet stack.

6. The image forming apparatus according to claim 3, further comprising:

a post-processing bypass transport path branching from the post-processing transport path, bypassing the sheet handling tray, and extending to a second sheet stack portion provided between the first sheet stack and the image reading unit; and a bypass sheet output unit configured to output sheets from the same direction as the sheets subjected to post-processing; wherein the second sheet stack portion is configured to stack the sheet output from the bypass sheet output unit.

7. The image forming apparatus according to claim 3, wherein the sheet handling tray is located within a curvature of the post processing transport path so as to provide unobstructed access to the post processing transport path.

8. The image forming apparatus according to claim 1, wherein the second sheet output unit is disposed above the first sheet output unit.

9. The image forming apparatus according to claim 1, further comprising:

a first pre-processing transport path configured to transport, to the first sheet output unit, the sheet on which the image is formed in the image forming unit;

a second pre-processing transport path configured to transport, to the post-processing unit, the sheet on which the image is formed in the image forming unit; and a switching member configured to switch a transport direction of the sheet between the first pre-processing transport path and the second pre-processing transport path.

10. The image forming apparatus according to claim 1, wherein-the controller is configured to detect when the interruption image formation not including post-processing is finished based on the second sheet sensor detecting a trailing end of each sheet for the interruption image formation process that does not include post-processing.

11. The image forming apparatus according to claim 1, wherein, after the second sheet sensor detects that the interruption image formation not including post-processing is finished, the controller is configured to suspend restart of the image formation including post-processing.

12. The image forming apparatus according to claim 1, wherein the post-processing unit is formed as a unit detachably mountable to an apparatus body of the image forming apparatus by a positioning member provided on a lateral side of a mount section of the post-processing unit to engage the apparatus body.

13. The image forming apparatus according to claim 12, wherein the positioning member and the apparatus body include respective engage portions that engage each other to lock the post-processing unit to the apparatus body.

14. The image forming apparatus according to claim 5, wherein the post-processing unit is formed as a unit detachably mountable to an apparatus body of the image forming apparatus, and wherein the post-processing unit includes a mount section mountable to the apparatus body from the same direction as the direction in which the sheet is output by the first sheet output unit, the mount section provided between the first sheet stack and the image reading unit.

15. An image forming apparatus, comprising:

image forming means for forming an image on a sheet;

sheet stack means for stacking the sheet on which the image is formed by the image forming means, the sheet stack means defined as an a single tray at an upper face of the image forming means;

sheet output means including, a first sheet output means configured to output sheets not subjected to post-processing such that the sheets not subjected to post-processing are output directly to the sheet stack means, and a second sheet output means configured to output sheets subjected to post-processing directly to the first sheet stack that is the single tray;

post-processing means for executing post-processing on the sheet on which the image is formed by the image forming means, the post-processing means provided adjacent to a lateral side of the image forming means at an upstream side of the sheet output means, the post processing means including, a sheet handling means configured to, store a plurality of sheets, up to a set capacity, internally in the image forming apparatus in a direction perpendicular to a direction in which the first sheet output means and the second sheet output means output the sheets; and align the sheet on which the image is formed therein with the plurality of sheets stored in the sheet handling means using a pivotable tap roller configured to send the sheet on which the image is formed therein into the sheet handling means such that the sheet enters the sheet handling means in the direction perpendicular to the direction in which the first sheet output unit and the second sheet output unit output the sheets, and a discharge means including a hooking means located on an outer circumferential surface of the discharge means, the discharge means configured to rotate such that the hooking means carries the sheets subjected to post-processing from the sheet handling means to the second sheet output means, and a controlling means for controlling, the controlling means configured to, receive, during execution of an image formation process of sheets to be subjected to post-processing, a first signal generated internally by the image forming apparatus instructing the controlling means to perform an interruption image formation process that does not include post-processing;

execute, for a first number of sheets, the image forming process of the sheets to be subjected to post-processing, the first number of sheets being less than the set capacity of the sheet handling means plus a number of sheets that can be arranged along a path between the image forming means and the second sheet output means;

transport the first number of sheets to be subjected to post-processing to the post-processing means and execute post-processing on the first number of sheets to be subjected to post-processing in parallel and simultaneously with the interruption image formation process that does not include post-processing, when the image forming process for the first number of sheets to be subjected to post-processing concludes;

hold the first number of sheets that have been subjected to post-processing at the second sheet output means until the controlling means receives a second signal from a second sheet sensor indicating that the interruption image formation process that does not including post-processing is finished; and discharge, using the hooking means, the first number of sheets that have been subjected to post-processing that are held at the second sheet output means such that the sheets begin to emerge from the second sheet output means immediately upon rotation of the discharge means.

* * * * *